US009097026B2

(12) United States Patent
Hoffman et al.

(10) Patent No.: US 9,097,026 B2
(45) Date of Patent: Aug. 4, 2015

(54) TOOL-LESS SWING ARM MECHANICAL EDGE SETTING SYSTEM AND METHOD FOR SETTING TILES AND TUNING LIPPAGE

(71) Applicant: New Standards Manufacturing Co., Keokuk, IA (US)

(72) Inventors: James P. Hoffman, Keokuk, IA (US); Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

(21) Appl. No.: 14/265,719

(22) Filed: Apr. 30, 2014

(65) Prior Publication Data

US 2014/0325935 A1 Nov. 6, 2014

Related U.S. Application Data

(60) Provisional application No. 61/818,196, filed on May 1, 2013.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04F 21/22*** | (2006.01) |
| ***E04F 21/00*** | (2006.01) |
| ***E04F 21/18*** | (2006.01) |

(52) U.S. Cl.

CPC ..... *E04F 21/22* (2013.01); *E04F 21/0092* (2013.01); *E04F 21/1877* (2013.01)

(58) Field of Classification Search

USPC ..... 52/747.11, 749.11, 222, 126.6, 389, 52/384

See application file for complete search history.

(56) References Cited

U.S. PATENT DOCUMENTS

| | | | |
|---|---|---|---|
| 1,918,228 | A | 7/1933 | Spencer |
| 2,277,892 | A | 3/1942 | Swenson |
| 3,511,001 | A | 5/1970 | Morgan |
| 4,397,125 | A | 8/1983 | Gusler |
| 5,345,990 | A | 9/1994 | Potts |
| 5,603,195 | A | 2/1997 | Cosentino |
| 5,675,942 | A | 10/1997 | Crawford |
| 5,843,546 | A | 12/1998 | Eichhorn |
| 6,253,515 | B1 | 7/2001 | Kuelker |

(Continued)

FOREIGN PATENT DOCUMENTS

| | | | |
|---|---|---|---|
| JP | 07-305494 | A | 11/1995 |
| WO | PCT/US2012/055482 | | 5/2013 |

OTHER PUBLICATIONS

Kufner et al, The Lippage-Free Tile System, Web (www.tuscanleveling.com), 2006, Fairfield, IA.

*Primary Examiner* — Brian Glessner
*Assistant Examiner* — Brian D Mattei
(74) *Attorney, Agent, or Firm* — Simmons Perrine Moyer Bergman PLC

(57) ABSTRACT

A tile aligning and lippage tuning system that uses an under tile base reusable upright connecting tab, which is detachably connected to said under tile base, a reusable flexible edge slotted cap, configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile, even if undesired elongation of the connecting tab occurs.

19 Claims, 8 Drawing Sheets

(56) References Cited

U.S. PATENT DOCUMENTS

| | | | |
|---|---|---|---|
| 7,257,926 | B1 | 8/2007 | Kirby |
| D552,266 | S | 10/2007 | Murdock |
| 7,621,100 | B2 | 11/2009 | Kufner et al. |
| D621,966 | S | 8/2010 | Vaes |
| D630,077 | S | 1/2011 | Kufner et al. |
| D630,078 | S | 1/2011 | Kufner et al. |
| 7,861,487 | B2 | 1/2011 | Kufner et al. |
| 7,946,093 | B1 | 5/2011 | Sturino |
| D640,119 | S | 6/2011 | Kufner et al. |
| 7,954,300 | B1 | 6/2011 | Kufner et al. |
| 7,992,354 | B2 | 8/2011 | Doda |
| 8,011,164 | B2 | 9/2011 | Kufner et al. |
| 8,079,199 | B1 | 12/2011 | Kufner et al. |
| D658,963 | S | 5/2012 | Kufner et al. |
| 8,336,279 | B2 | 12/2012 | Kufner et al. |
| 8,429,878 | B1 | 4/2013 | Hoffman et al. |
| 8,429,879 | B1 | 4/2013 | Hoffman et al. |
| 8,561,370 | B1 | 10/2013 | Hoffman et al. |
| 8,572,927 | B1 | 11/2013 | Hoffman et al. |
| 8,607,530 | B2 | 12/2013 | Hoffman et al. |
| 8,689,521 | B1 | 4/2014 | Hoffman et al. |
| 8,689,522 | B2 | 4/2014 | Hoffman et al. |
| 2006/0185269 | A1 | 8/2006 | Kufner et al. |
| 2006/0185319 | A1 | 8/2006 | Kufner et al. |
| 2010/0263304 | A1 | 10/2010 | Comas |
| 2010/0287868 | A1 | 11/2010 | Kufner et al. |
| 2011/0011031 | A1 | 1/2011 | Kufner et al. |
| 2011/0265424 | A1 | 11/2011 | Kufner et al. |
| 2012/0085066 | A1 | 4/2012 | Kufner et al. |
| 2012/0144773 | A1 | 6/2012 | Mauro |
| 2013/0255182 | A1 | 10/2013 | Kufner et al. |

TOOL-LESS SWING ARM MECHANICAL EDGE SETTING SYSTEM AND METHOD FOR SETTING TILES AND TUNING LIPPAGE

BACKGROUND OF THE INVENTION

This invention relates to systems and methods for laying tile and, more specifically, for efficiently reducing tile lippage. Throughout this description, the term tile is used as an example of various matter which is arranged or disposed adjacent a substrate (which can be horizontal—floors or vertical—walls or other) in multiple pieces, the term tile should be understood to include panels, sheets, boards, paving stones, bricks, stone or porcelain slabs or the like. The present invention relates more specifically to improved methods and systems which use tab systems to align tiles.

U.S. Pat. No. 7,861,487, U.S. Design Pat. No. D63077 and the web site www.tuscanleveling.com describe a system for aligning tiles. While such systems have enjoyed some success in the past, they do have drawbacks. Typically, such systems require the use of a tool to tighten a strap and cap combination. The tile laying professional would typically use the tool by firmly grasping a lever, trigger or other structure on the tool and causing the gap between the cap and the base of the strap to decrease. The amount and duration of the squeezing of the tool, in some designs, may determine the amount of relative movement between the cap and the base of the strap. Knowing how hard to squeeze and when to stop could be a critical skill in certain applications. Also having the requisite hand grasping strength could be an issue for some tile laying professionals.

Consequently, there is a need for improvement in tile aligning and lippage tuning systems and methods.

SUMMARY OF THE INVENTION

More specifically, an object of the invention is to provide a cost effective tile aligning and mechanical edge setting system.

It is a feature of the present invention to include a tool-less cap structure disposed above the tile.

It is an advantage of the present invention to decrease the time required to perform each job.

It is another feature of the invention to include a cap system that is swing arm that is detachable from the tab or shaft, while the tab remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to reduce over tightening of cap and strap combinations.

The present invention includes the above-described features and achieves the aforementioned objects.

Accordingly, the present invention comprises a tile leveling and mechanical edge setting system with a swing arm cap, which is easily installed on, and removable from, an attached connecting tab or shaft without the need for a specialized tool.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
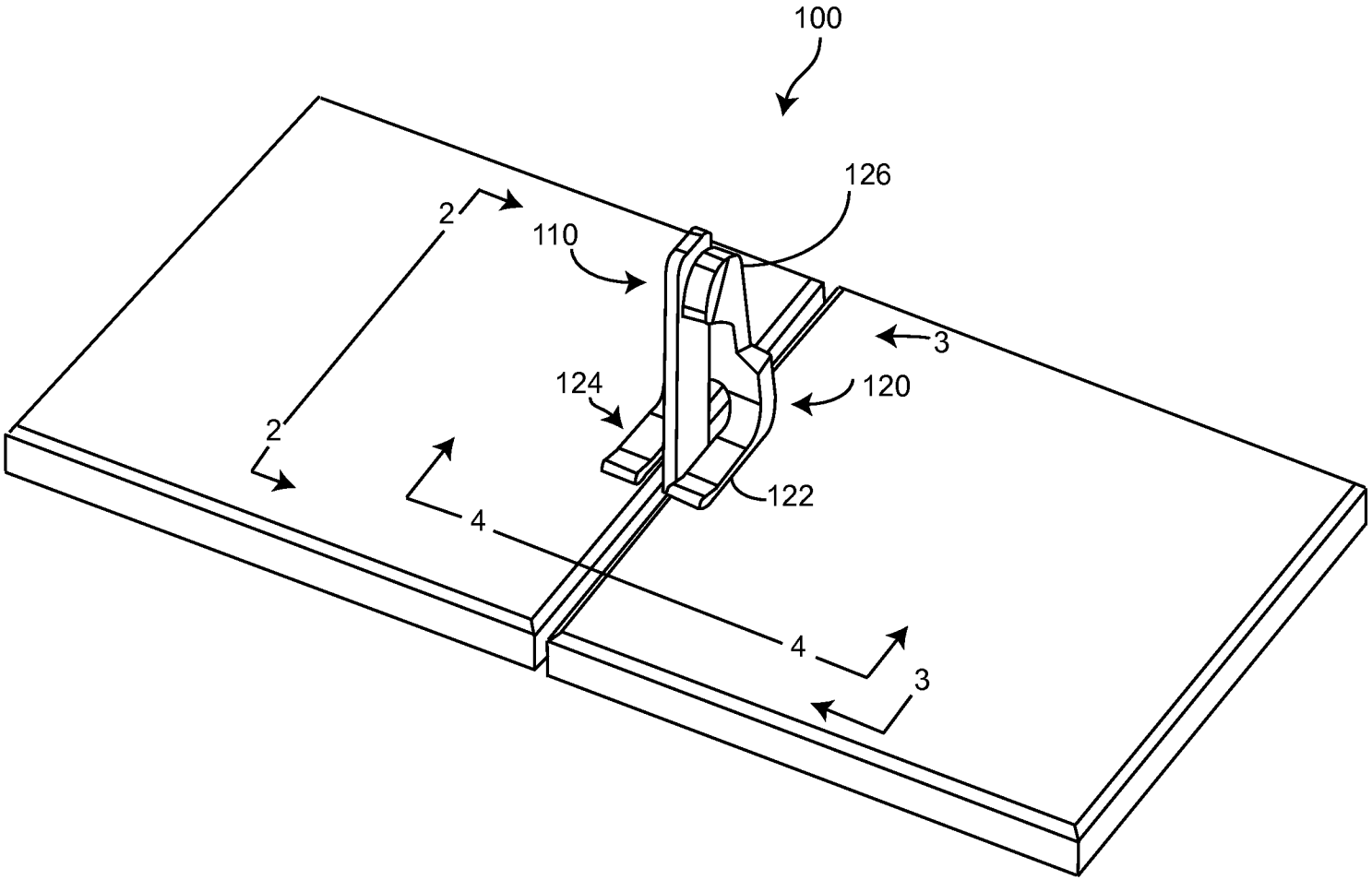
FIG. 1 is a perspective view of the mechanical edge setting and lippage tuning system of the present invention, in its intended environment, when the swing arm is in a position of relatively high pressure.

Referring now to the drawings, where like numerals refer to like matter throughout, and more particularly to FIG. 1, there is shown a mechanical edge setting and lippage tuning system 100, which generally includes an interstitial strap 110 and a swing arm cap 120. Interstitial strap 110 may be disposed in the interstices between adjacent tiles and may be made of metal, plastic, or rubber coated metal or other suitable materials. Interstitial strap 110 has a bulbous pin portion receiving hole 204 (FIGS. 2 and 4) therein. Interstitial strap 110 need not have the plurality of ridges that are common on many prior art straps. Swing arm cap 120 is disposed on the finished side of an array of tiles, with a joint therebetween. Swing arm cap 120 is shown having a swing arm cap mating stop portion 126, and a first swing arm cap foot portion 122, and a second swing arm cap foot portion 124. These may be formed from a single piece or multiple pieces of the same or dissimilar material. First swing arm cap foot portion 122 and second swing arm cap foot portion 124 need to be resilient so as to act like a spring when compressed downward toward the tile. Note that swing arm cap mating stop portion 126 need not be as resilient but may be, if so desired. Interstitial strap 110 and swing arm cap 120 may be made of similar materials as prior art systems, such as described in the above-referenced patent.

Interstitial strap 110 and swing arm cap 120 are configured so that interstitial strap 110 remains stationary, while swing arm cap 120 pivots around interstitial strap 110.

The materials used, the size and the shape of swing arm cap 120, and particularly first swing arm cap foot portion 122 and second swing arm cap foot portion 124, may be different depending upon the thickness of the tile, the grout or thin set material or other factors. An assortment of differently made swing arm caps 120 could be utilized to address these many different variables. The various versions of the swing arm cap 120, in such an assortment, could be configured to be used with a common interstitial strap 110. In some cases, the differences between variations of interstitial strap 110 could be simply the length of the separation between the first swing arm cap foot portion 122 and the pivot point on the swing arm cap mating stop portion 126.

Figure 2:
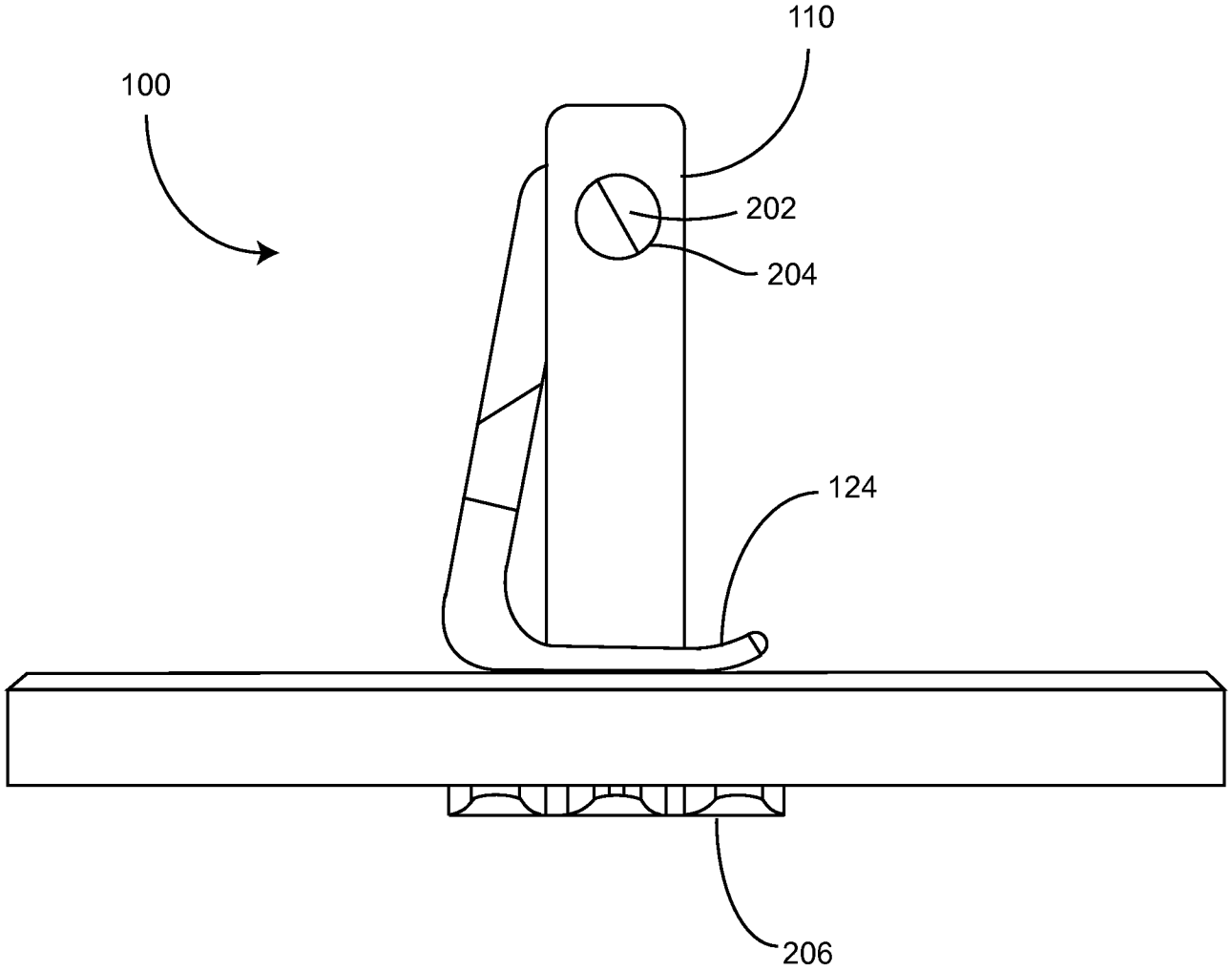
FIG. 2 is a cross-sectional view of the system of FIG. 1 taken on line 2-2.

Now referring to FIG. 2, there is shown a cross-sectional view of the system of FIG. 1, which shows the swing arm cap bulbous pin portion 202 of the swing arm cap mating stop portion 126 extending through the bulbous pin portion receiving hole 204 in interstitial strap 110. The under tile detachable plate 206 is shown disposed beneath the tile. Swing arm cap 120 is shown in a fully engaged orientation.

Figure 3:
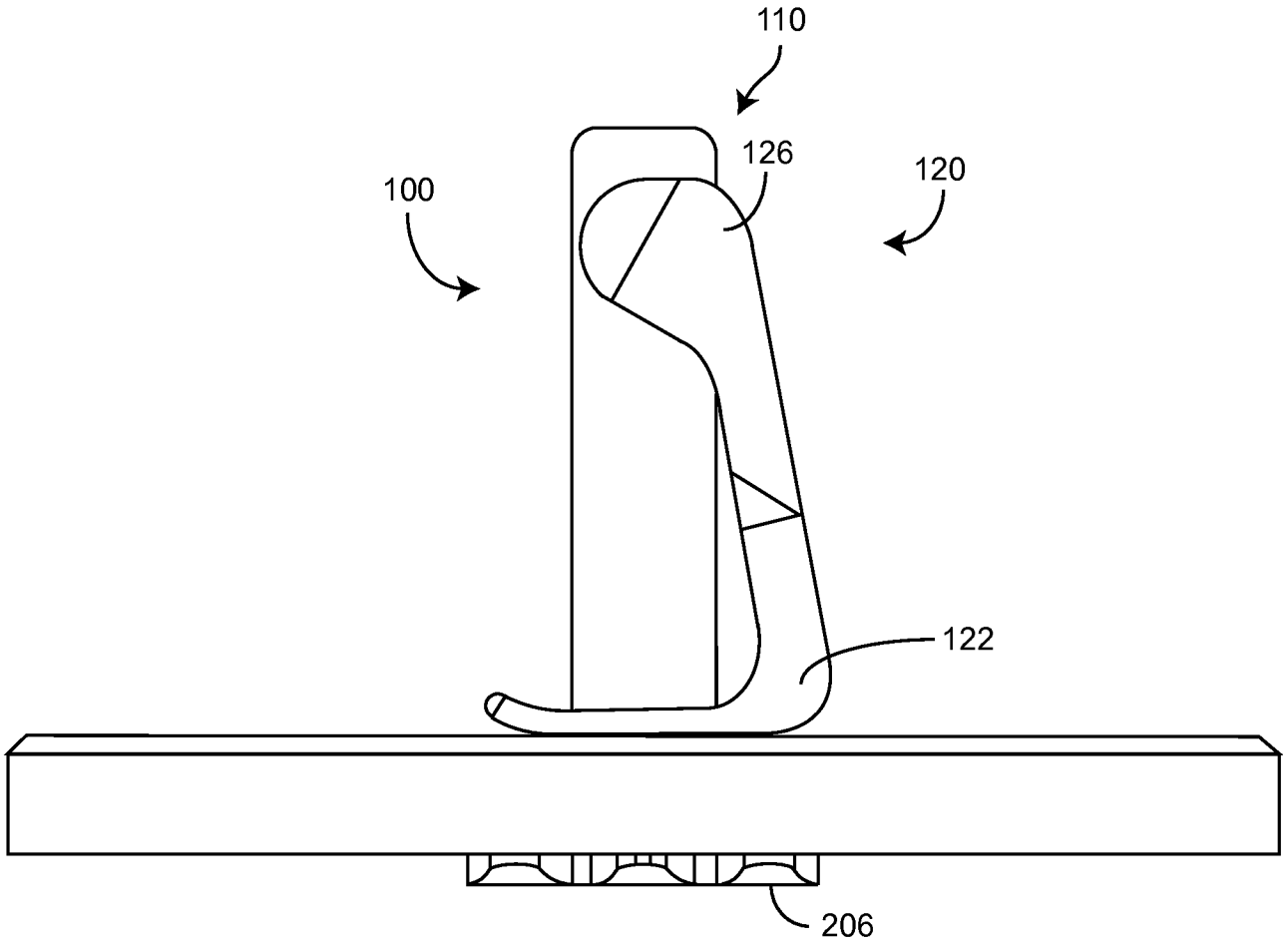
FIG. 3 is a cross-sectional view of the system of FIG. 1 taken on line 3-3.

Now referring to FIG. 3, there is shown the cross-sectional view of the tool-less swing arm lippage reducing system 100 of FIG. 1. Swing arm cap 120 is shown in a fully engaged orientation.

Figure 4:
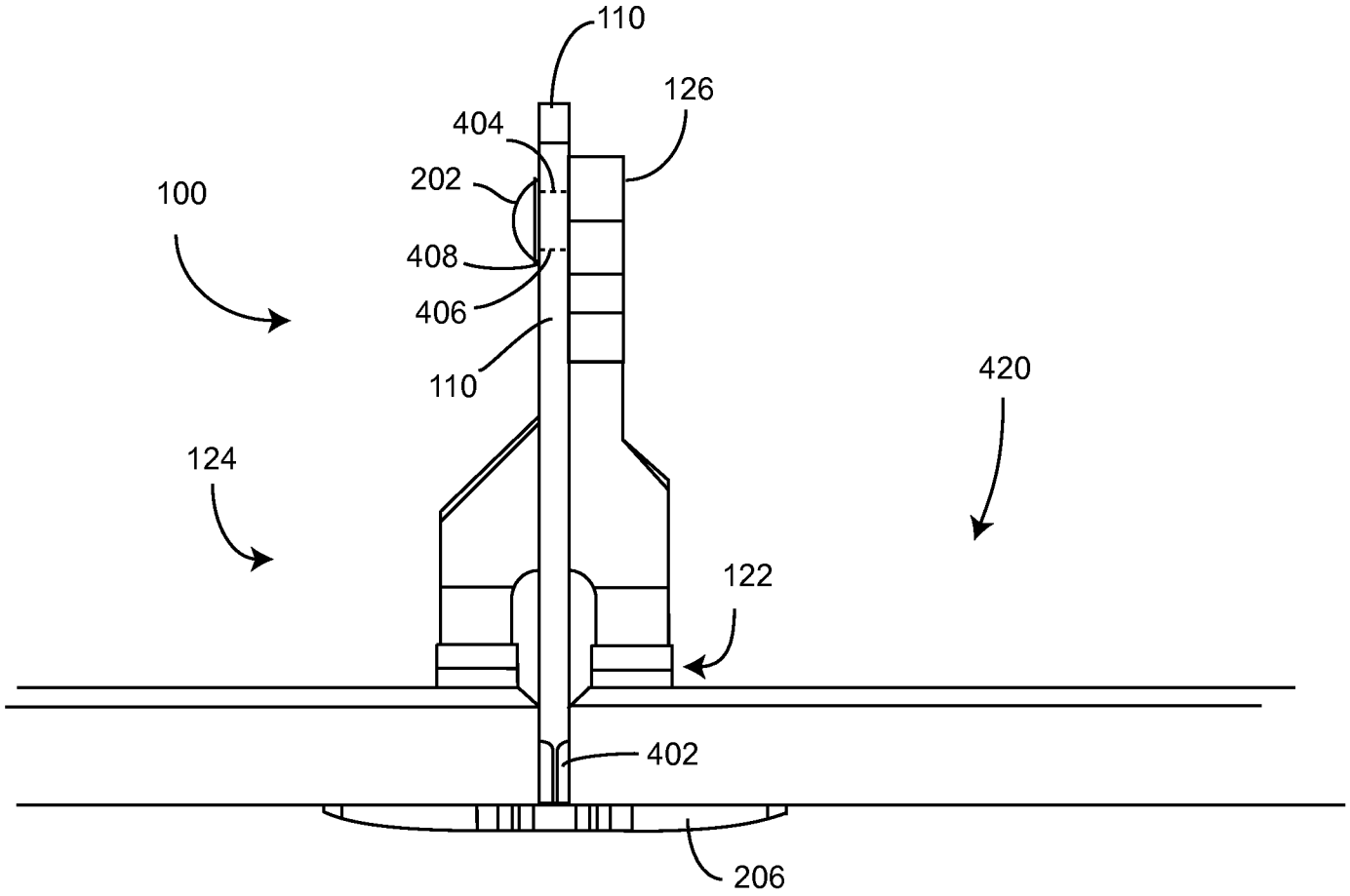
FIG. 4 is a cross-sectional view of the system of FIG. 1 taken on line 4-4 where the dotted lines show otherwise concealed portions.

Now referring to FIG. 4, there is shown a cross-sectional representation of the tool-less swing arm lippage reducing system 100 of FIG. 1, which shows swing arm cap mating stop portion 126 adjacent to the interstitial strap 110, and the swing arm cap bulbous pin portion 202 disposed on opposite side of interstitial strap 110 from first swing arm cap foot portion 122. A dotted line is included to show pin inner shaft portion top edge 404 and pin inner shaft portion bottom edge 406. The swing arm cap bulbous pin portion 202 has a bulbous pin portion terminal edge 408, which is adjacent to one side of interstitial strap 110, while swing arm cap mating stop portion 126 is adjacent to an opposite side of the interstitial strap 110. Assembly of the tool-less swing arm lippage reducing system 100 can be by merely pushing the swing arm cap bulbous pin portion 202 through bulbous pin portion receiving hole 204. Also shown are strap foot pin receiving portion 402 and under tile detachable plate 206. A swing arm axis 420 is shown extending the swing arm cap bulbous pin portion 202 and out of swing arm cap mating stop portion 126. In FIGS. 2 and 3, this swing arm axis 420 is not shown, because it would be extended in a line perpendicular to the plane of these figures.

Figure 5:
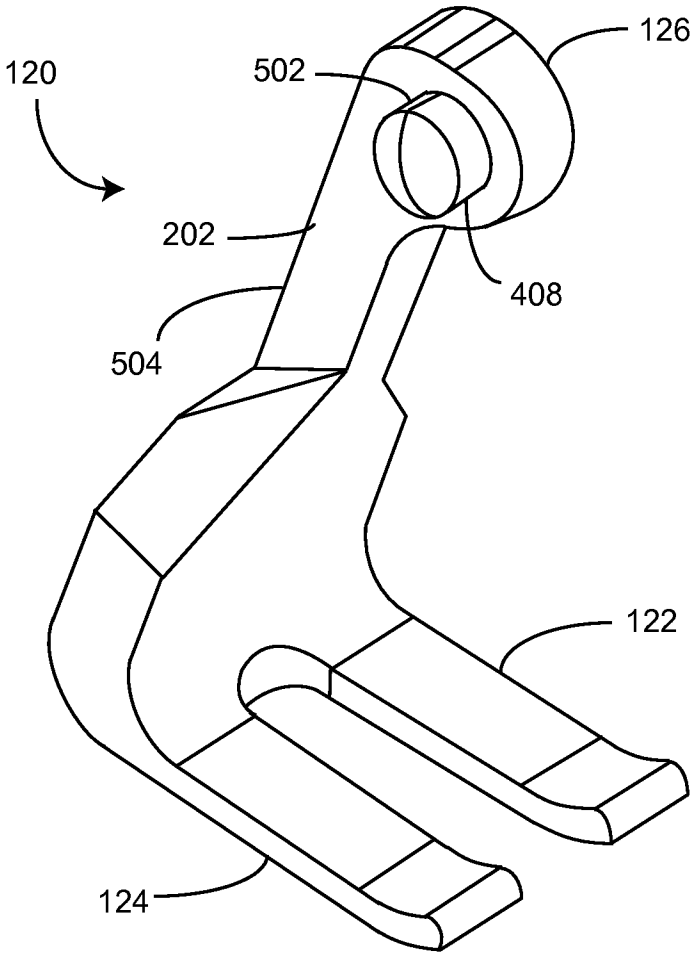
FIG. 5 shows a perspective view of the swing arm portion of the present invention.

Now referring to FIG. 5, there is shown a perspective view of swing arm cap 120. Pin inner shaft 502 is shown disposed between the swing arm cap bulbous pin portion 202 and the opposing side of swing arm cap mating stop portion 126. Pin inner shaft 502 is essentially the axel around which swing arm cap 120 pivots with respect to interstitial strap 110. An intermediate extension region 504 is shown disposed between pin inner shaft 502 and either first swing arm cap foot portion 122 or second swing arm cap foot portion 124. In some variations of swing arm cap 120, the intermediate extension region 504 would be made longer to accommodate thinner tile. The extension of the intermediate extension region could be accomplished by having a threaded screw shaft extending from the first portion into a treaded sleeve in the second portion and adjusting the amount of extension by merely rotating the first portion with respect to the second portion. Other extension mechanism could be used, such as a sliding and nested tubular arrangement with retention pins or set screws or other similar or suitable structures. Alternatively, the accommodation for variable tile thickness could be achieved by providing a plurality of spaced apart bulbous pin portion receiving holes 204 along the interstitial strap 110.

Figure 6:
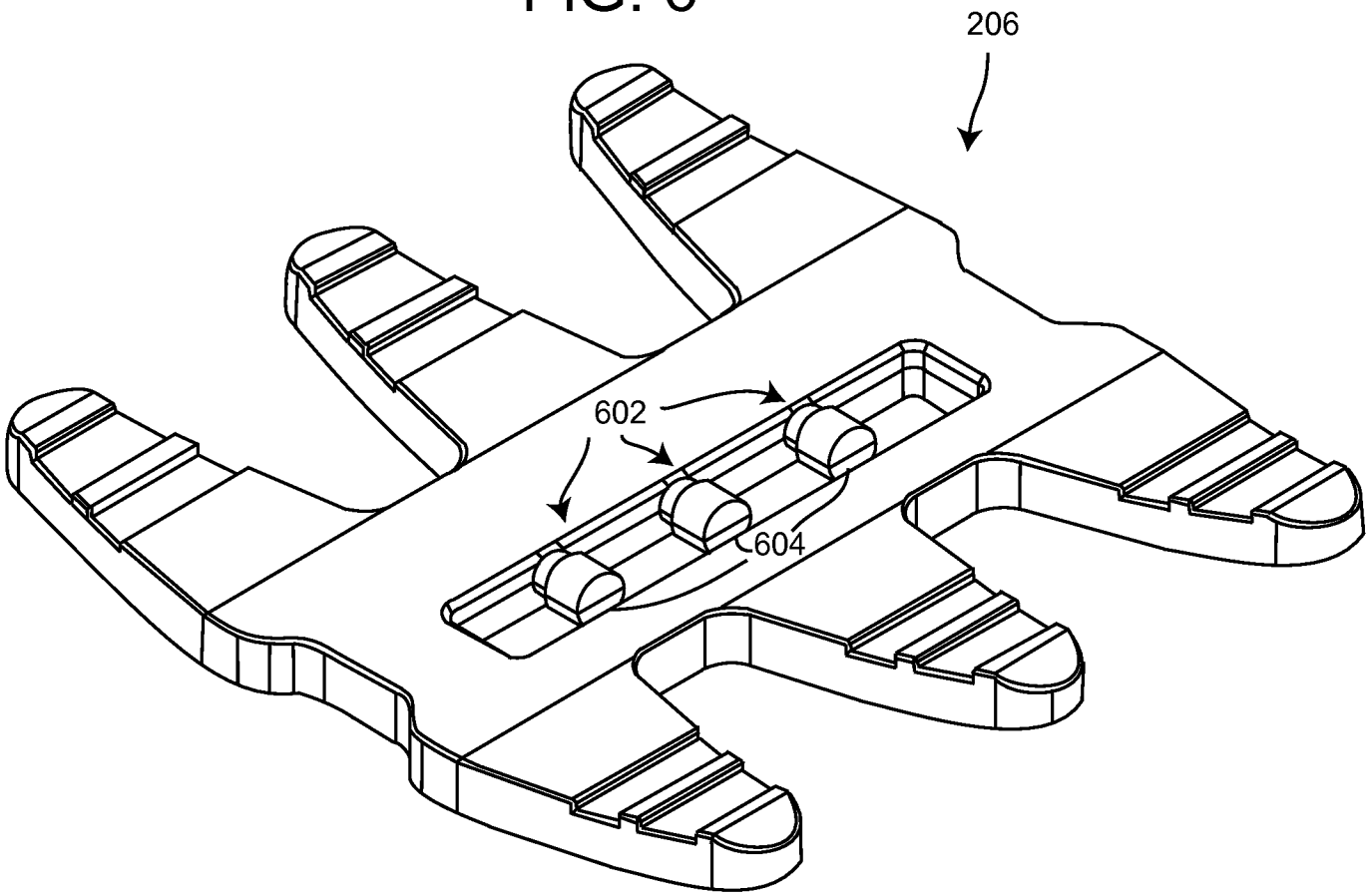
FIG. 6 shows a close up of a universal plate portion of the present invention.

Now referring to FIG. 6, there is shown under tile detachable plate 206, which is configured with a strap receiving void for receiving therein an interstitial strap 110. Under tile detachable plate 206 is specially designed to allow the interstitial strap 110 to be removed from attachment thereto by severing the various multi-diameter stepped plates to strap mating pins 602. In one embodiment, these pins are made so that they can be relatively easily broken and thereby facilitate removal of interstitial strap 110 by forcibly separating it from the multi-diameter stepped plate to strap mating pins 602. .

Figure 7:
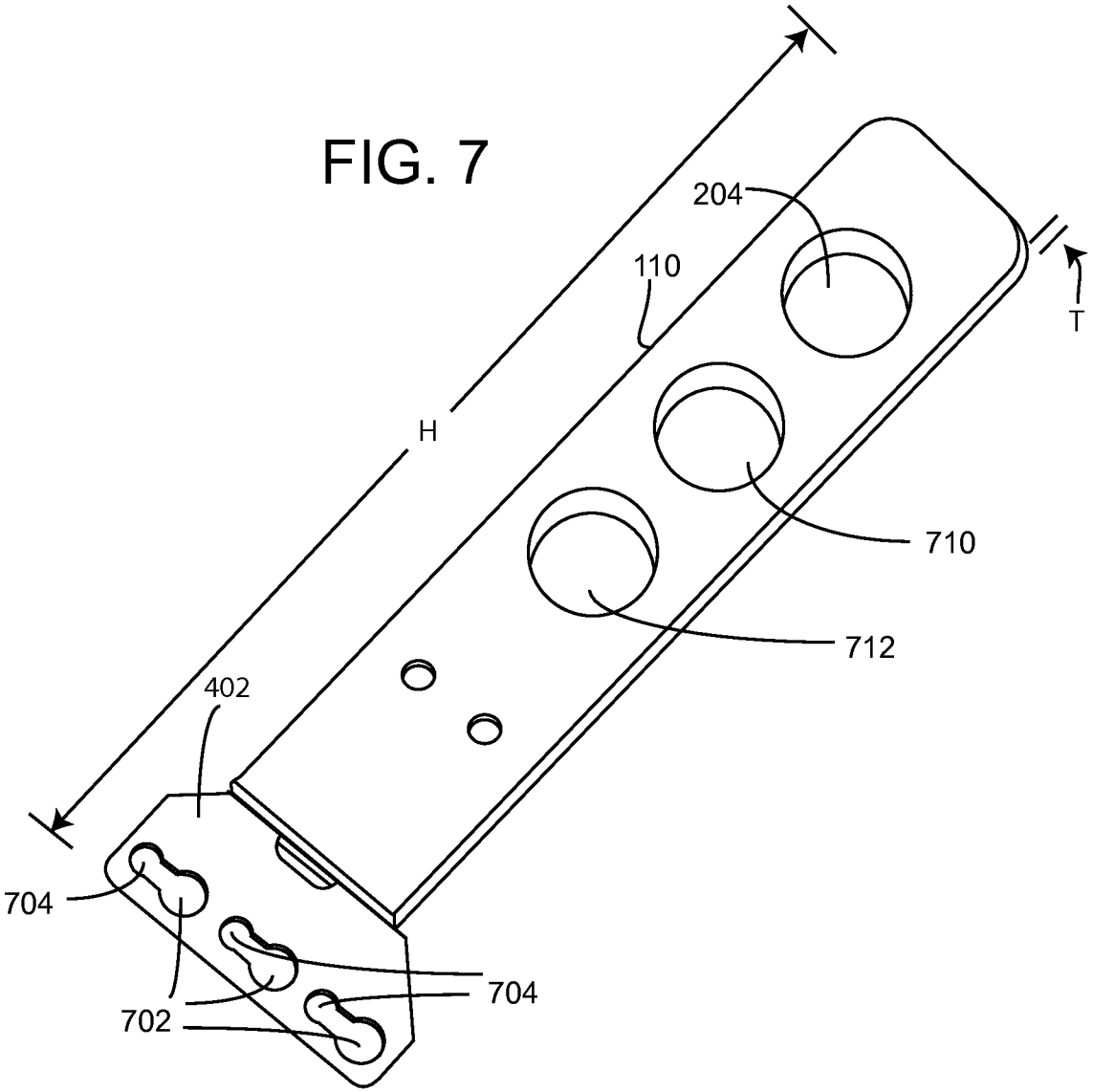
FIG. 7 shows a perspective view of a reusable strap of the present invention.

Now referring to FIGS. 6 and 7, in another embodiment, the plate to strap mating pin enlarged terminal portion 604 have a larger end, which is designed to facilitate ease of insertion followed by retention of interstitial strap 110 on the multi-diameter stepped plate to strap mating pins 602 during the process of using the system to reduce lippage. The insertion process can be reversed, and the plate to strap mating pin enlarged terminal portion 604 can be aligned with enlarged terminal portion receiving hole 702, so as to be easily removed through the enlarged portions.

When the interstitial strap 110 is pulled laterally and the plate to strap mating pin enlarged terminal portion 604 is moved away from the enlarged terminal portion receiving hole 702, the play between the interstitial strap 110 and the under tile detachable plate 206 is dramatically reduced, (i.e. the permitted range of relative movement is made much smaller). The direction of force to shear multi-diameter stepped plate to strap mating pins 602 is orthogonal to the force used to tighten and reduce the play in the interstitial strap 110, is also shown with a bulbous pin portion receiving hole 204, a middle hole 710 for thinner tile than used with bulbous pin portion receiving hole 204, and a bottom hole 712 for even thinner tile. The height of the strap is labeled H, while the width of the strap is labeled W and the thickness of the strap is labeled T.

Figure 8:
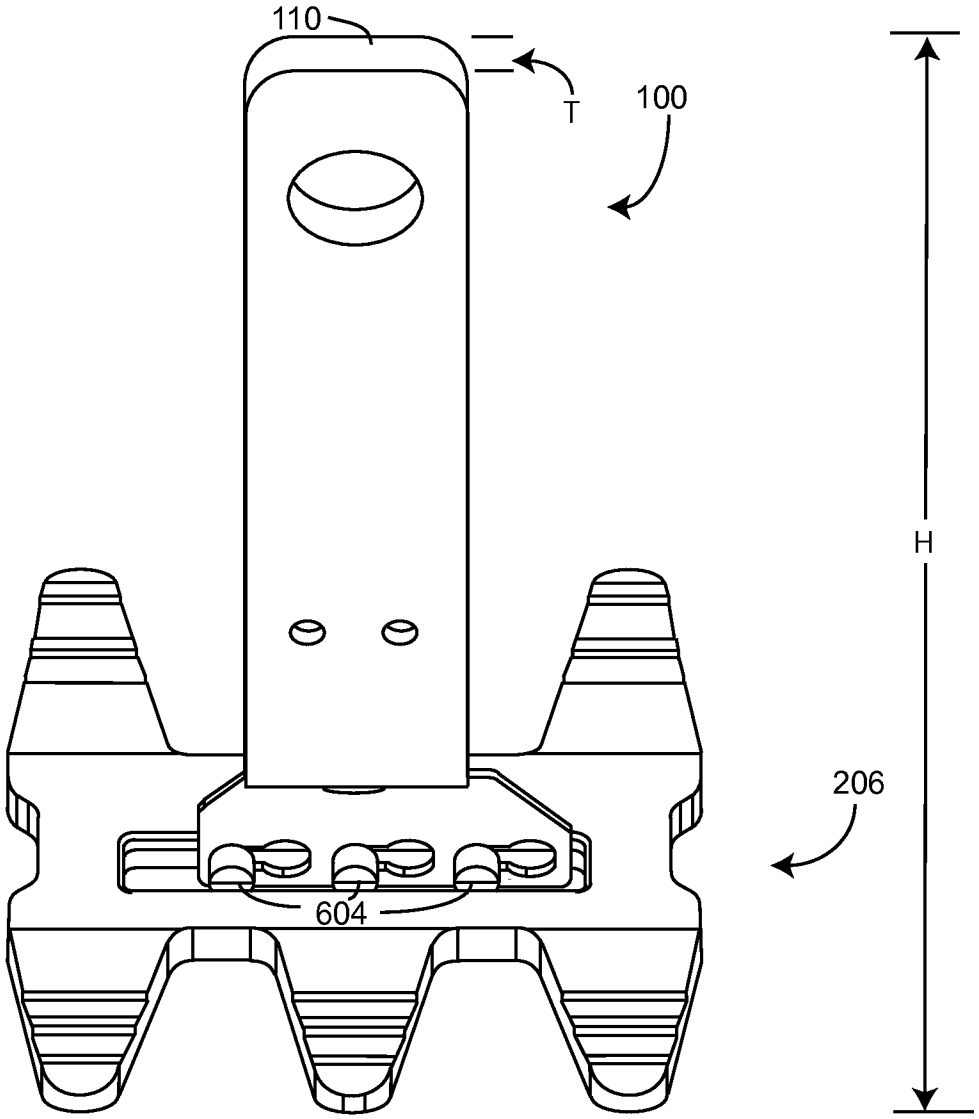
FIG. 8 shows a perspective view of the plate of FIG. 6 and the strap of FIG. 7 in an assembled orientation, without any tile or a swing arm present.

Now referring to FIG. 8, there is shown a view of a sub-assembly of the present invention, which includes the interstitial strap 110 couple to under tile detachable plate 206 with the multi-diameter stepped plate to strap mating pins 602 disposed in the plate to strap engaging portion 704, i.e. the sub assembly is in a configuration to reduce play between the interstitial strap 110 and the under tile detachable plate 206.

Throughout this description, the term lippage is used and is hereby defined as meaning relatively uneven edges existing with respect to adjacent tiles arranged in an array.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A method of reducing lippage comprising the steps of:

providing a substrate upon which a plurality of tiles are to be laid;

providing a bonding material on said substrate configured to bond said substrate to said plurality of tiles;

providing a connecting tab having a first tab end and a second tab end;

providing a hidden side tile mating member, sized and configured to be placed adjacent to one of a said plurality of tiles, said mating member being coupled to said second tab end;

providing a rotating cap system coupled to said connecting tab, the system comprising:

a first portion comprising a pin and a second portion comprising a first tile contacting portion;

where said first portion is proximal to said first tab end and is configured to permit said pin to be rotated within said connecting tab and separated from said connecting tab, while said connecting tab remains coupled to said mating member;

wherein said connecting tab has a pin receiving hole therein and where said pin is detachably coupled to said connecting tab through said pin receiving hole;

wherein said pin receiving hole is sized and configured to allow said pin to rotate inside said pin receiving hole; and said first portion being configured so that when rotated about said connecting tab, a deflection in said second portion occurs, thereby creating a force which is applied across the plurality of tiles, where said force urges a said plurality of tiles in a direction away from said first tab end and toward said mating member.

2. The method of claim 1 wherein said first portion and said second portion are separated by an intermediate extension region.

3. The method of claim 2 wherein said intermediate extension region has a fixed length dimension.

4. The method of claim 1 further comprising a means for accommodating differing tile thicknesses by adjusting a bottom maximum extent of said rotating cap system.

5. The method of claim 4 wherein said means for accommodating comprises a plurality of rotating pin receiving holes in said connecting tab.

6. A method for reducing lippage in a plurality of tiles comprising the steps of:

Providing a substrate upon which a plurality of tiles are to be laid;

Providing a bonding material on said substrate configured to bond said substrate to said plurality of tile;

Providing a base in said bonding material;

Providing a first tile disposed on said base;

Providing an elongated strap extending from said base; where the elongated strap has a height above the base as a longest dimension along a strap longitudinal axis;

a width of the strap, which runs in a line parallel to a longitudinal axis of a grout joint containing said strap has a shorter dimension but a dimension that is longer than a thickness dimension of the strap in a line which is orthogonal to the longitudinal axis of the grout joint;

Providing a rotating swing arm which rotates around a swing arm axis passing through said elongated strap; and Providing a predetermined maximum pressure onto a surface of one of said plurality of tiles by rotating said rotating swing arm about the swing arm axis, which is in a plane parallel to and elevated above a plane of said plurality of tiles, where the swing arm axis is also perpendicular to a width axis of said elongated strap.

7. The method of claim 6 wherein said swing arm is detachably coupled to the elongated strap.

8. The method of claim 6 wherein said swing arm is vertically adjustable.

9. The method of claim 8 wherein said base has gripping teeth.

10. The method of claim 7 wherein said base member is configured to mate with a base mating portion of said elongated strap.

11. The method of claim 6 wherein said rotating swing arm further comprises a cap base portion.

12. The method of claim 11 wherein said cap base portion comprises a cap base portion core, a cap base flange and a cap base buttress.

13. A method of reducing lippage comprising the steps of:

providing a substrate upon which a plurality of tiles are to be laid;

providing a bonding material on said substrate configured to bond said substrate to said plurality of tiles;

providing a tab;

providing a base, configured to be placed adjacent to said plurality of tiles, said base having a void therein, which is configured to receive therein a portion of said tab;

providing a cap system comprising:

a lower cap spring-like portion and a cap rotating portion where said lower cap spring-like portion has a removal slot therein, which is sized and configured to permit said cap system to be pivoted, with a single swinging motion from lippage reducing pressure producing positions of tile surface contact simultaneously on both sides of said tab to a configuration providing reduced lippage reducing pressure; wherein said removal slot extends entirely to an exterior edge of said lower cap spring-like portion.

14. The method of claim 13 wherein said tab is an elongated member and said base is sized and configured to be placed below tile in a tile floor.

15. The method of claim 13 wherein said tab is reusable.

16. The method of claim 13 wherein said cap rotating portion is detachably coupled to said tab.

17. The method of claim 16 wherein said cap rotating portion is detachably coupled at plurality of locations along said tab which are configured to provide for adjustment of lippage reducing forces.

18. The method of claim 17 wherein said cap rotating portion is selectively deployable through a plurality of holes each located at one of said plurality of locations.

19. A method for reducing lippage in a plurality of tiles comprising the steps of:

providing a base;

providing a first tile disposed on said base;

providing an elongated strap extending from said base; where the elongated strap has; a height dimension which is above the base and is a longest dimension along a strap longitudinal axis;

a width dimension, which is shorter than said height dimension which runs in a line parallel to a longitudinal axis of a grout joint containing said elongated strap;

a thickness dimension, which is shorter than and orthogonal to said width dimension;

providing a rotating swing arm which rotates around a swing arm axis passing through said elongated strap; and providing a predetermined pressure onto a surface of said first tile by rotating said rotating swing arm about the swing arm axis, which is in a plane parallel to and elevated above a plane of said first tile, where the rotating swing arm axis is also perpendicular to said width dimension of said elongated strap.

* * * * *